US008175483B2

(12) United States Patent
Shiraki et al.

(10) Patent No.: US 8,175,483 B2
(45) Date of Patent: May 8, 2012

(54) IMAGE FORMING APPARATUS AND GRADATION CORRECTION TEST CHART

(75) Inventors: Seiji Shiraki, Saitama (JP); Yasuo Komatsu, Saitama (JP); Kiyoshi Une, Saitama (JP); Takumi Nishikata, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 373 days.

(21) Appl. No.: 12/552,637

(22) Filed: Sep. 2, 2009

(65) Prior Publication Data

US 2010/0215392 A1 Aug. 26, 2010

(30) Foreign Application Priority Data

Feb. 24, 2009 (JP) ..... 2009-041063

(51) Int. Cl.
*G03G 15/00* (2006.01)

(52) U.S. Cl. ..... 399/72; 399/49; 399/138; 399/180; 399/182

(58) Field of Classification Search ..... 399/49, 399/72, 138, 180, 182
See application file for complete search history.

(56) References Cited

U.S. PATENT DOCUMENTS 5,864,742 A * 1/1999 Gasper et al. ..... 399/366
7,130,076 B2 * 10/2006 Shibuya et al. ..... 358/1.9
7,509,065 B2 * 3/2009 Itagaki ..... 399/49
2001/0015815 A1 * 8/2001 Hada et al. ..... 358/1.9
2005/0219634 A1 * 10/2005 Murakami ..... 358/3.28
2008/0107434 A1 * 5/2008 Toyohara ..... 399/62
2008/0144060 A1 * 6/2008 Ishikawa ..... 358/1.9

FOREIGN PATENT DOCUMENTS

JP A-2001-111838 4/2001
JP A 2002-44455 2/2002
JP A-2001-111833 1/2007
JP A-2007-003781 1/2007

OTHER PUBLICATIONS

Japanese Office Action issued in Japanese Patent Application No. 2009-041063 dated Nov. 16, 2010 (with Translation).

* cited by examiner

*Primary Examiner* — David Gray
*Assistant Examiner* — Francis Gray
(74) *Attorney, Agent, or Firm* — Oliff & Berridge, PLC

(57) ABSTRACT

An image forming apparatus includes: print data generating unit for generating gradation correction test chart print data to juxtapose and draw a basis density pattern having a basis density of a yellow color and plural reference density patterns having respective densities of the yellow color compared with the basis density and additionally draw a contrast effect pattern composed of colors having a contrast effect on the yellow color; printing unit for printing a gradation correction test chart including a yellow color gradation correction pattern in which the basis density pattern and the plurality of reference density patterns are juxtaposed and printed and the contrast effect pattern is additionally printed; receiving unit for receiving an input of a density adjustment value of any pattern based on a shading comparison of the basis density pattern and the reference density patterns; and gradation correcting unit for performing a gradation correction.

6 Claims, 12 Drawing Sheets

REFERENCE DENSITY PATTERN
YELLOW (LOW DENSITY) 80%

IMAGE FORMING APPARATUS AND GRADATION CORRECTION TEST CHART

CROSS-REFERENCE TO RELATED APPLICATIONS

This application is based on and claims priority under 35 USC 119 from Japanese Patent Application No. 2009-041063 filed on Feb. 24, 2009.

BACKGROUND

1. Technical Field

The present invention relates to an image forming apparatus and a gradation correction test chart.

2. Related Art

In image output apparatuses such as color laser printers and the like, it is common that a gradation characteristic is varied due to factors such as temporal variation, environmental variation, individual difference of apparatuses or the like.

As methods for correcting a gradation characteristic varied due to such factors, there are known techniques called "calibration", "gradation correction" and "color balance correction."

These techniques are techniques for correcting a gradation characteristic by printing a patch composed of a variety of colors and then comparing the printed patch with a preprinted reference chart or reading the printed patch by visual observation or with a measuring instrument.

In addition, as methods which can be constructed at low costs without requiring any measuring instrument and reference chart, there have been proposed various methods in which a basis density pattern and a gradation pattern having gradations varied gradually are juxtaposed and printed, shading of the gradation pattern with respect to the basis density pattern is determined by visual observation, and a gradation characteristic is corrected so that an image can be printed at a density close to the basis density pattern.

In addition, for image output apparatuses for reproducing a full color using 3 or more colors such as, for example, Y (yellow), M (magenta) and C (cyan) or Y, M, C and K (black), there is known a calibration method of using a gradation correction test chart in which a band of a basis density pattern as a basis used for printing is arranged in an upper side and several reference density patterns having different densities for each color are arranged in a lower side and the basis density pattern and the reference density patterns of each density are arranged and printed for each color, and a reference density pattern closest to the upper basis density pattern is selected.

At that time, how to make the shading determination as easy as possible was carefully deliberated, such as printing the basis density pattern with a low line number screen strong against density variation (i.e., little density variation) due to the above-mentioned factors, and printing the reference density patterns with a high line number screen used for actual user data printing.

In addition, there is known a method using density contrast patterns of, for example, high density, middle density and low density for each color as one gradation correction test chart in order to provide a precise shading determination and improve a correction precision.

However, in the calibration of the image output apparatuses for color printing, even the gradation correction test chart of one of the above-mentioned types (type of printing a shading contrast pattern of each color on one sheet or type of printing a shading contrast pattern having a plurality of densities for each color on one sheet) could not easily provide a shading determination of the basis density pattern and the reference density patterns for shading contrast patterns of particularly Y (yellow) color among Y, M and C colors or Y, M, C and K color.

This is because the yellow color is greatly varied in a saturation direction for density variation but is little varied in a brightness direction.

In addition, with the yellow color little varied in the brightness direction, since the yellow color is typically printed on a highly bright white recording sheet having a basis density pattern and a density contrast pattern, a shading determination becomes more difficult due to a small brightness difference between the white brightness of the sheet and each pattern of the yellow color.

SUMMARY

An image forming apparatus includes: print data generating unit for generating gradation correction test chart print data to juxtapose and draw a basis density pattern having a basis density of a yellow color of various colors including the yellow color used for multicolor printing and a plurality of reference density patterns having respective densities of the yellow color to be compared with the basis density and additionally draw a contrast effect pattern composed of colors having a contrast effect on the yellow color for the basis density pattern and the reference density patterns of the yellow color; printing unit for printing a gradation correction test chart including a yellow color gradation correction pattern in which the basis density pattern and the plurality of reference density patterns are juxtaposed and printed and the contrast effect pattern is additionally printed, based on the gradation correction test chart print data generated by the print data generating unit; receiving unit for receiving an input of a density adjustment value of any pattern based on a shading comparison of the basis density pattern and the reference density patterns by a user's visual observation of the density correction test chart printed by the printing unit; and gradation correcting unit for performing a gradation correction of any pattern based on the density adjustment value of any pattern received by the receiving unit.

BRIEF DESCRIPTION OF THE DRAWINGS

Exemplary embodiments of the invention will be described in detail based on the following figures, wherein.

DETAILED DESCRIPTION

Hereinafter, exemplary embodiments of the present invention will be described with reference to the accompanying drawings.

Figure 1:
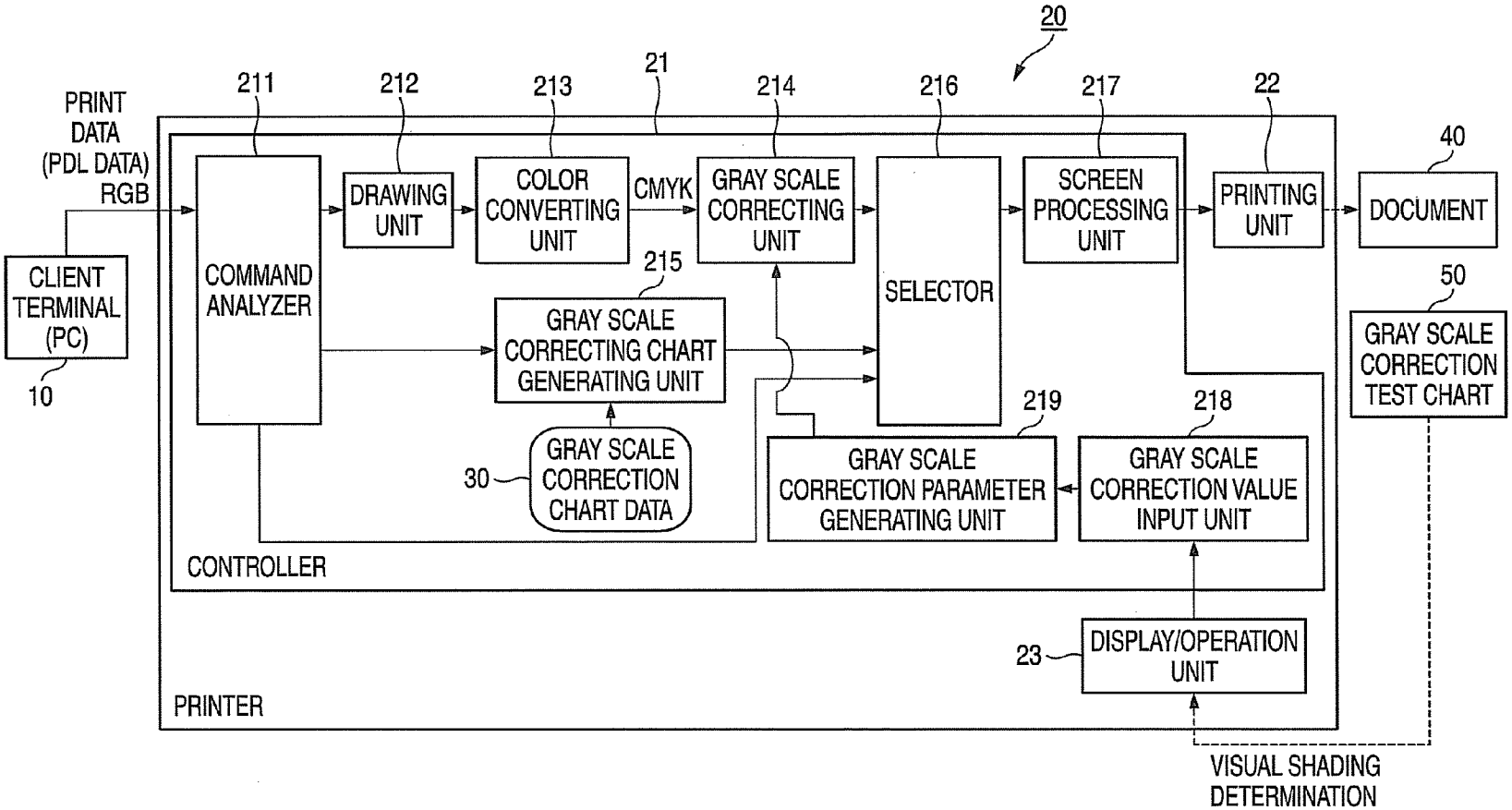
FIG. 1 is a block diagram showing a functional configuration of a printer according to exemplary embodiments of the present invention.

FIG. 1 is a block diagram showing a functional configuration of a printer 20 according to exemplary embodiments of the present invention.

The printer 20 includes a controller 21 which processes an print instruction (command) from a client terminal 10 implemented by, for example, a personal computer (PC), a printing unit (printing unit in the claims) 22 which prints an image based on print data output as a result of the processing of the command by the controller 21, a display/operating unit 23 which includes a display part for displaying various information such as operation guidance, operation conditions and so on and an input part including input devices such as a keyboard, a mouse and the like.

The controller 21 includes a command analyzer 211, a drawing unit 212, a color converting unit 213, a gradation correcting unit 214, a gradation correction chart generating unit 215, a selector 216, a screen processing unit 217, a gradation correction value input unit 218, and a gradation correction parameter generating unit 219. The command analyzer 211 analyzes a command from the client terminal 10 and, as a result of the analysis, performs an input switching control of a selector (which will be described later) 216 depending on whether the command is a normal print instruction or an instruction to output a gradation correction test chart (hereinafter referred to as "gradation correction chart"). The drawing unit 212 performs a drawing process to deploy document data [Printer Description Language (PDL) data] of a print object into a bitmap image by rendering the data if the command analyzer 211 analyzes the command to be the normal print instruction. The color converting unit 213 color-converts the PDL (print data) deployed into the bitmap image from color data of R, G and B into color data of C, M, Y and K. The gradation correcting unit 214 corrects a gradation of the color-converted print data. The gradation correction chart generating unit 215 generates gradation correction chart data (gradation correction test chart print data in the claims) for printing the gradation correction chart if the command analyzer 211 analyzes the command to be the instruction to output the gradation correction chart. The selector 216 can be switched to select and output one of the output data of the gradation correcting unit 214 and the output data of the gradation correction chart generating unit 215. The screen processing unit 217 performs a screen process for the data selected by the selector 216 (the data after the gradation correction by the gradation correcting unit 214 or the gradation correction chart data generated by the gradation correction chart generating unit 215). The gradation correction value input unit 218 receives an input of gradation correction values corresponding to any gradation correction pattern based on a determination of shading of a basis density pattern and a reference density pattern by a visual observation of a user on the gradation correction chart (see FIGS. 4, 6, 7, 13 and 14) printed by the printing unit 22 based on the gradation correction chart data screen-processed by the screen processing unit 217. The gradation correction parameter generating unit 219 generates gradation correction parameters based on the gradation correction values received by the gradation correction value input unit 218 and inputs the generated gradation correction parameters to the gradation correcting unit 214.

The printing unit 22 includes color image forming units for forming images of, for example, Y (yellow) color, M (magenta) color, C (cyan) color and K (black) color using corresponding toners (Y), (M), (C) and (K), respectively, and prints a document 40 or a gradation correction chart [gradation correction chart 50 (see FIG. 4) or the like] in color according to an electro-photographic process for each color based on the print data [print data for printing the document or print data for printing the gradation correction chart (gradation correction chart data)] output from the screen processing unit 217 through the above-described processes by the controller 21.

Figure 2:
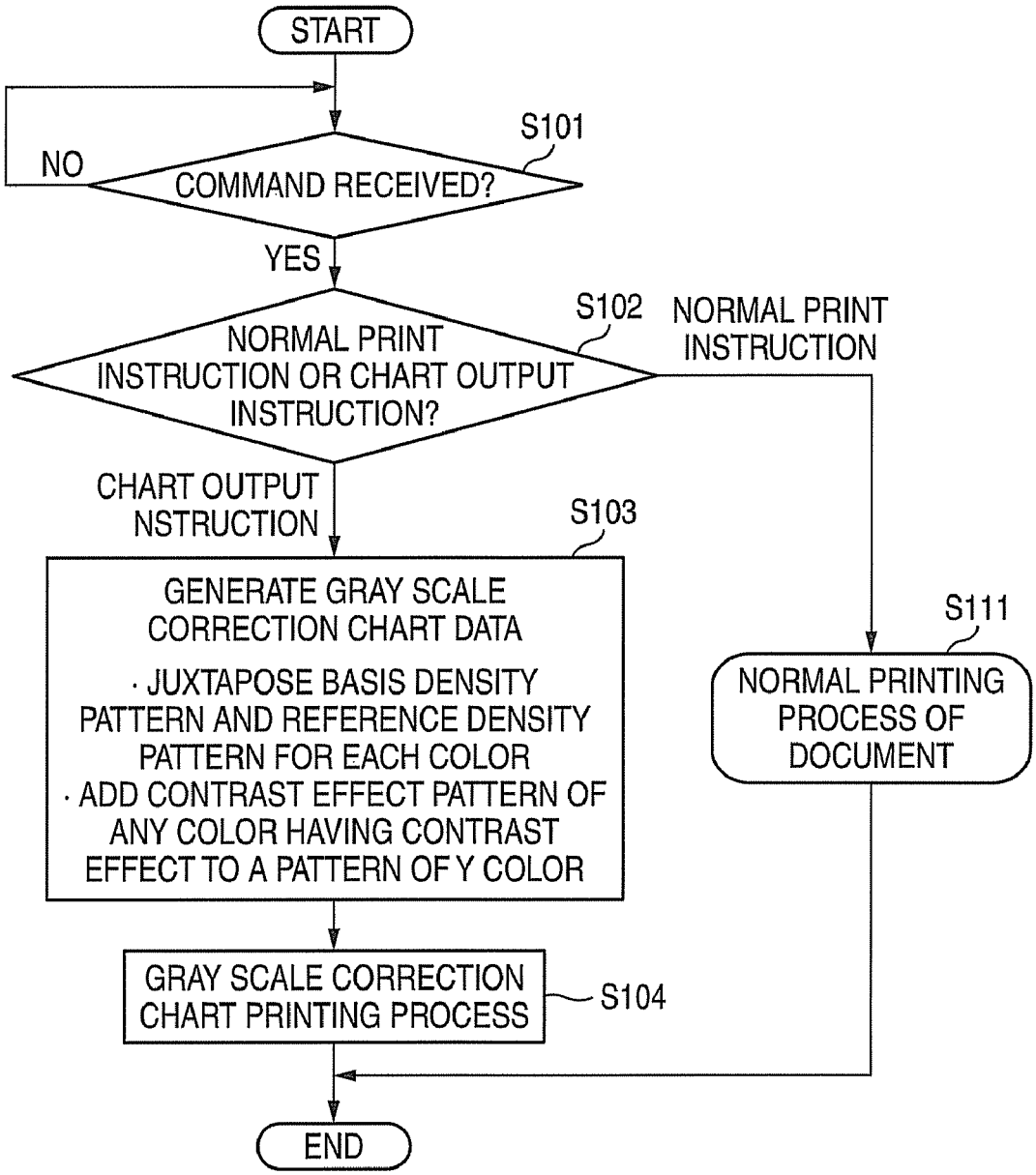
FIG. 2 is a flow chart showing a print processing operation of the printer according to the exemplary embodiments.

FIG. 2 is a flow chart showing a print processing operation of the printer 20 according to the exemplary embodiments.

As shown in FIG. 2, while waiting, the command analyzer 211 of the printer 20 monitors whether or not a command is received from the client terminal 10 (Step S101).

Upon receiving the command from the client terminal 10 (YES in Step S101), the command analyzer 211 analyzes the command and determines whether the command is a normal print instruction or a gradation correction chart print instruction (chart output instruction) (Step S102).

If it is determined that the command is a normal print instruction (normal print instruction in Step S102), a printing process is performed based on document data (PDL data) of a print object included in the command (Step S111).

In this case, first, the drawing unit 212 renders the document data (PDL data) of the print object and deploys the document data into a bitmap image composed of color components of R, G and B.

Next, the color converting unit 213 color-converts image data of the bitmap of R, G and B into image data composed of color components of Y, M, C and K.

Subsequently, the gradation correcting unit 214 corrects a gradation of the image data of Y, M, C and K color-converted by the color converting unit 213 and outputs the gradation-corrected image data.

Based on a result of the command analysis in Step S102 (the command being the normal print instruction), the command analyzer 211 instructs the selector 216 to select an output of the gradation correcting unit 214.

Based on the instruction, the selector 216 inputs the image data of Y, M, C and K, which has been gradation-corrected by the gradation correcting unit 214, to the screen processing unit 217.

The screen processing unit 217 screen-processes the input gradation-corrected image data and sends a result of the screen processing to the printing unit 22.

Based on the image data of Y, M, C and K input from the screen processing unit 217, the printing unit 22 forms an electrostatic latent image according to gradation information of each color component on a photoconductor for each pixel, develops the electrostatic latent image into each color toner image, transfers and fixes the color toner image onto a recording medium (recording sheet) through an electro-photographic process, thereby printing and outputting a multicolor-mixed image (color image) on the recording sheet.

On the other hand, if it is determined that the command received in Step S101 is a chart output instruction (chart output instruction in Step S102), the command analyzer 211 sends a generation instruction of a gradation correction chart data to the gradation correction chart generating unit 215, and the gradation correction chart generating unit 215 generates gradation correction chart data based on the generation instruction of the gradation correction chart data and outputs the generated gradation correction chart data (Step S103).

Here, the gradation correction chart data (denoted by reference numeral 30 in FIG. 1) may be stored in advance, and the gradation correction chart generating unit 215 instructed to generate the gradation correction chart data may read and output the gradation correction chart data.

Based on a result of the command analysis in Step S102 (the command being the chart output instruction), the command analyzer 211 instructs the selector 216 to select an output of the gradation correction chart generating unit 215.

Based on the instruction, the selector 216 inputs the gradation correction chart data, which has been generated in Step S103 by the gradation correction chart generating unit 215, to the screen processing unit 217.

The screen processing unit 217 screen-processes the input gradation correction chart data and sends a result of the screen processing to the printing unit 22.

Based on the gradation correction chart data input from the screen processing unit 217, the printing unit 22 subjects the data to the above-mentioned electro-photographic process, thereby printing and outputting a gradation correction chart [gradation correction chart 50 (see FIG. 4) and so on] composed of color images on a recording sheet (Step S104).

In Step S103 of a series of printing processes shown in FIG. 2, the gradation correction chart generating unit 215 generates the gradation correction chart data (bitmap data) for printing, for example, the gradation correction chart 50 (see FIG. 4) having an array of a plurality of gradation correction patterns in which basis density patterns having basis density and reference density patterns having density to be compared with the density of the basis density patterns for each of colors of, for example, Y, M and C are juxtaposed.

In the present invention, the gradation correction chart data for printing the gradation correction chart, such as, for example, the gradation correction chart 50, generated by the gradation correction chart generating unit 215 has data content including an instruction to additionally draw a contrast effect pattern composed of colors having a brightness contrast effect or a saturation contrast effect on a yellow color with respect to a yellow gradation correction pattern of the gradation correction patterns corresponding to various colors.

Here, the reason for additionally drawing a contrast effect pattern composed of colors having a brightness contrast effect on a yellow color will be described.

Figure 3A:
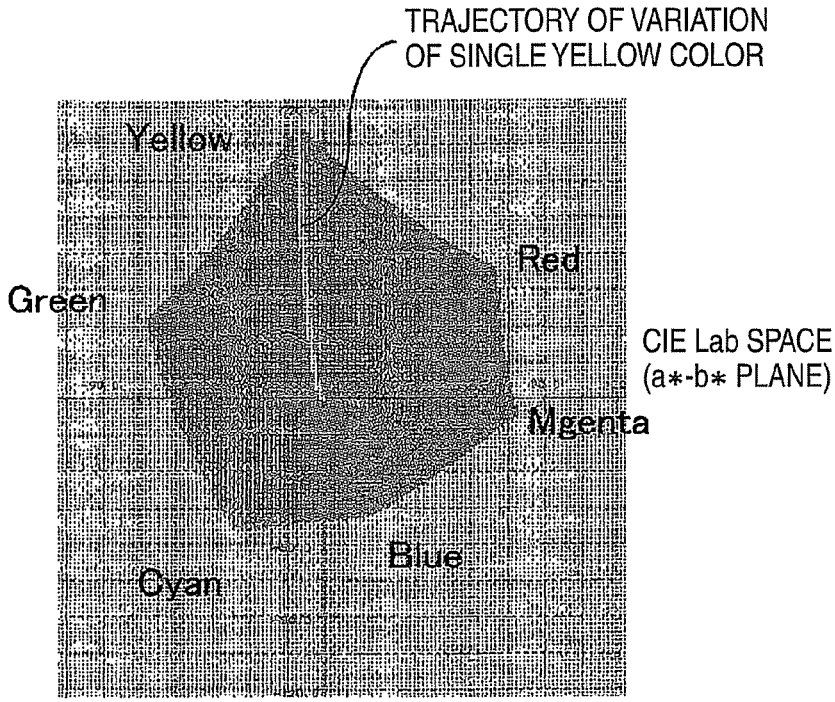
FIGS. 3A and 3B are views showing color reproducibility in a CIE Lab color space of a laser printer.
Figure 3B:
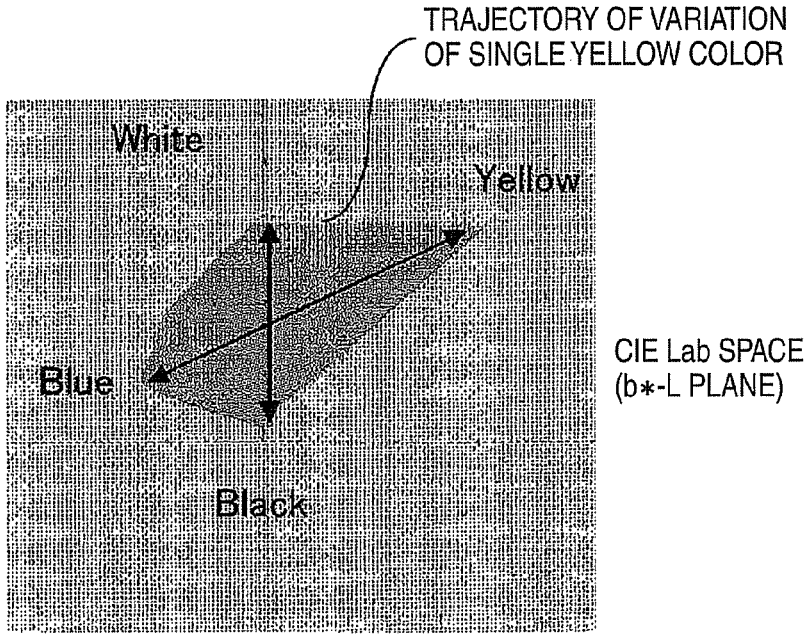

FIGS. 3A and 3B are views showing color reproducibility in a CIE Lab color space in a laser printer such as the printer 20 of the present invention or the like when various colors of Y, M and C (or Y, M, C and K) are used for multicolor printing.

FIG. 3A shows color reproducibility in an a*–b* plane and FIG. 3B shows color reproducibility in a b*–L plane.

In the CIE Lab color space, a gradation curve of yellow monochrome has a trajectory as shown in FIG. 3A in the a*–b* plane and a trajectory as shown in FIG. 3B in the b*–L plane.

As can be seen from the trajectories of the gradation curve of yellow monochrome, a yellow color of high density has particularly high saturation in an a*+ direction while a brightness of the yellow color of high density is also high, and a yellow color of low density increases in brightness as it decreases in saturation.

Accordingly, from a standpoint of the validity of a contrast effect on a yellow color, a saturation contrast is valid for yellow color of high density and a brightness contrast is valid for yellow color of low density.

Specifically, the color having greatly different saturation from that of the yellow color is a dark blue color, which is the opposite hue (a*–), and the one having greatly different brightness from that of the yellow color is a black color [see FIG. 3B].

From the above standpoint, in the printer 20 of the present invention, by arranging a saturation contrast effect pattern by a dark blue color for a gradation correction pattern of high density (density exceeding a preset density) of yellow color and arranging a brightness contrast effect pattern by a black color for a gradation correction pattern of low density (density less than the preset density) of yellow color, shading variation of the basis density patterns and the reference density patterns in the gradation correction patterns of high and low densities of yellow color is highlighted.

Hereinafter, examples of the gradation correction chart of the present invention in which contrast effect patterns of colors having a saturation or brightness contrast effect for the gradation correction pattern of yellow color are juxtaposed will be described in detail by way of embodiments.

First Exemplary Embodiment

Figure 4:
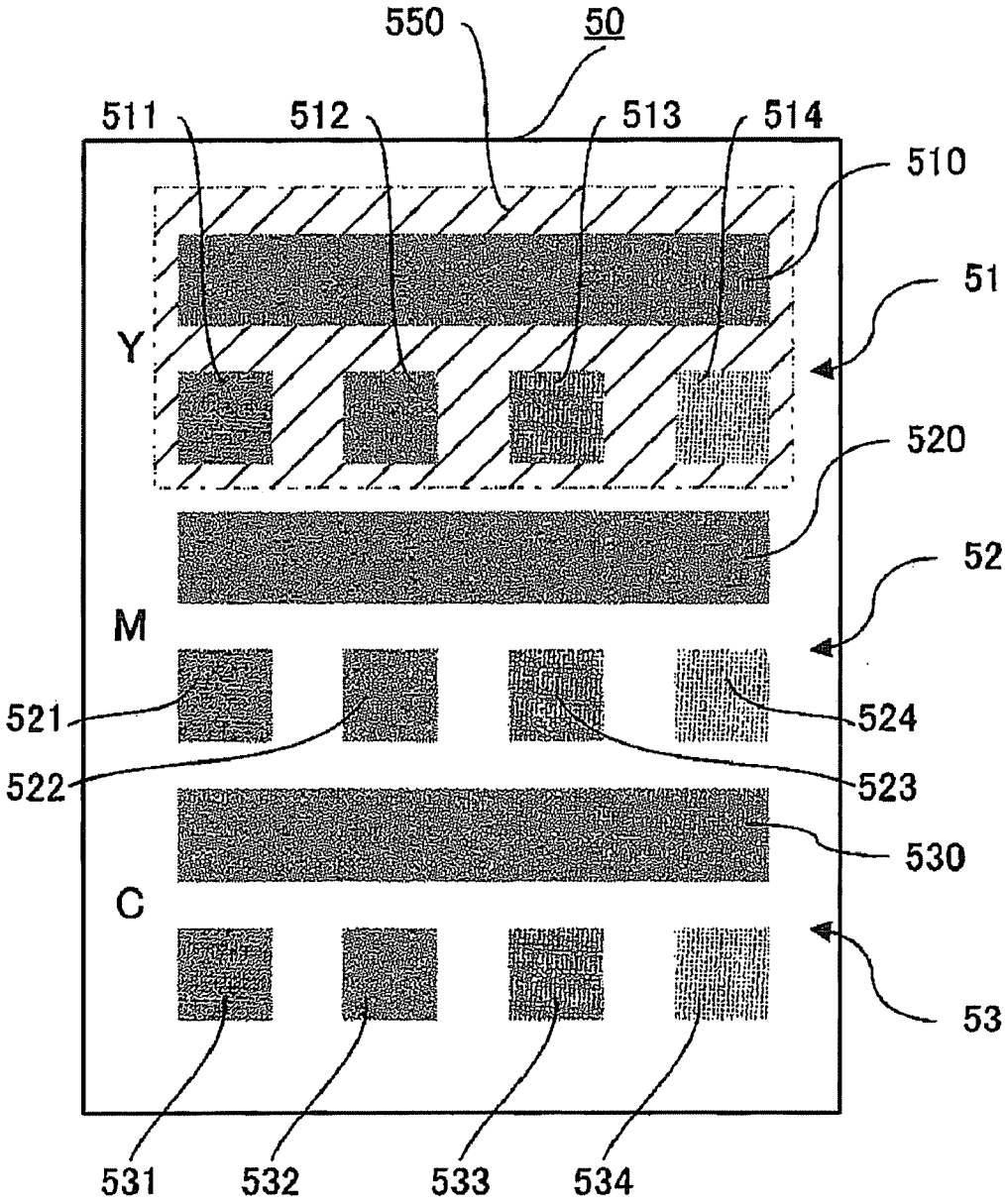
FIG. 4 is a view showing a result of printing of a gradation correction chart according to a first exemplary embodiment.

FIG. 4 is a view showing a print result of the gradation correction chart 50 in the printer 20 according to a first exemplary embodiment.

As shown in FIG. 4, the gradation correction chart 50 includes a Y color gradation correction pattern 51 printed as a Y (yellow) color on the upper side, an M color gradation correction pattern 52 printed as an M color on the middle side, and a C color gradation correction pattern 53 printed as a C color on the lower side.

The Y color gradation correction pattern 51 has a structure in which a basis density pattern 510 having a basis density of Y color and extending in the form of a band in a horizontal direction and reference density patterns lying below the basis density pattern 510 and having gradually varying densities to be compared with the basis density of Y color, that is, a reference density pattern 511 having a predetermined density, a reference density pattern 512 having a density lower than that of the reference density pattern 511, a reference density pattern 513 having a density lower than that of the reference density pattern 512, and a reference density pattern 514 having a density lower than that of the reference density pattern 513, are arranged and juxtaposed in a horizontal direction (band shape).

The M color gradation correction pattern 52 has a structure in which a basis density pattern 520 having a basis density of M color and extending in the form of a band in a horizontal direction and reference density patterns lying below the basis density pattern 520 and having gradually varying densities to be compared with the basis density of M color, that is, a reference density pattern 521 having a predetermined density, a reference density pattern 522 having a density lower than that of the reference density pattern 521, a reference density pattern 523 having a density lower than that of the reference density pattern 522, and a reference density pattern 524 having a density lower than that of the reference density pattern 523, are arranged and juxtaposed in a horizontal direction (band shape).

The C color gradation correction pattern 53 has a structure in which a basis density pattern 530 having a basis density of C color and extending in the form of a band in a horizontal direction and reference density patterns lying below the basis density pattern 530 and having gradually varying densities to be compared with the basis density of C color, that is, a reference density pattern 531 having a predetermined density, a reference density pattern 532 having a density lower than that of the reference density pattern 531, a reference density pattern 533 having a density lower than that of the reference density pattern 532, and a reference density pattern 534 having a density lower than that of the reference density pattern 533, are arranged and juxtaposed in a horizontal direction (band shape).

In addition, in the gradation correction chart 50, a contrast effect pattern 550 of a dark blue color [a color farthest from the yellow color on the CIE Lab color space (see FIGS. 3A and 3B) which is arranged as a complementary color of the yellow color] having a saturation contrast effect on the yellow color is arranged around the basis density pattern 510 and the reference density patterns 511, 512, 513 and 514 constituting the Y color gradation correction pattern 51.

When the printer 20 of the first exemplary embodiment prints such a gradation correction chart 50, based on a print instruction of the gradation correction test chart from the client terminal 10, the gradation correction chart generating unit 215 of the functional configuration shown in FIG. 1 generates gradation correction test chart print data including bitmap data for juxtaposing and drawing the basis density pattern having the basis density of each of the Y, M and C colors and the plurality of reference density patterns having respective densities to be compared with the basis density and bitmap data for drawing the contrast effect pattern of the dark blue color having the saturation contrast effect on the yellow color around the yellow color basis density pattern and the reference density patterns.

The screen processing unit 217 has a low line number line screen composed of a predetermined screen angle and line number M and a high line number line screen corresponding to each of the Y, M and C colors, which is composed of a predetermined screen angle and line number N (for example, N>M) different from that of the low line number line screen.

The screen processing unit 217 uses the low line number line screen to screen-process the basis density pattern data of each color and the contrast effect pattern data of the gradation correction test chart print data generated by the gradation correction chart generating unit 215 and uses the high line number line screen corresponding to each color to screen-process the reference density pattern data of each color.

Based on the gradation correction test chart print data screen-processed by the screen processing unit 217, as shown in FIG. 4, the printing unit 22 prints the gradation correction test chart 50 in which the basis density pattern having the basis density of each of the Y, M and C colors and the plurality of reference density patterns having the respective densities of each color to be compared with the basis density are juxtaposed and printed (as the gradation correction patterns 51, 52 and 53) and the contrast effect pattern 550 of the dark blue color having the saturation contrast effect on the yellow color around the yellow color basis density pattern and the reference density patterns are printed.

Thereafter, a user compares shadings of the basis density pattern and the reference density pattern for each color on the printed gradation correction chart 50 by visual observation, selects a reference density pattern for each color which appears to have a density equal to (closest to) that of the basis density pattern, and designates (inputs) a gradation correction value corresponding to a result of the selection (the selected reference density pattern) from, for example, an operation part of the display/operation unit 23.

On the other hand, in the printer 20, the gradation correction value input unit 218 receives a gradation correction value of any pattern for each color input from the display/operation unit 23. The gradation correction parameter generating unit 219 generates a received gradation correction parameter corresponding to the gradation correction value of any pattern, and sends the generated gradation correction parameter to the gradation correcting unit 214. The gradation correcting unit 214 performs a gradation correction on the arbitrary pattern of each corresponding color component based on the gradation correction parameter.

Figure 5A:
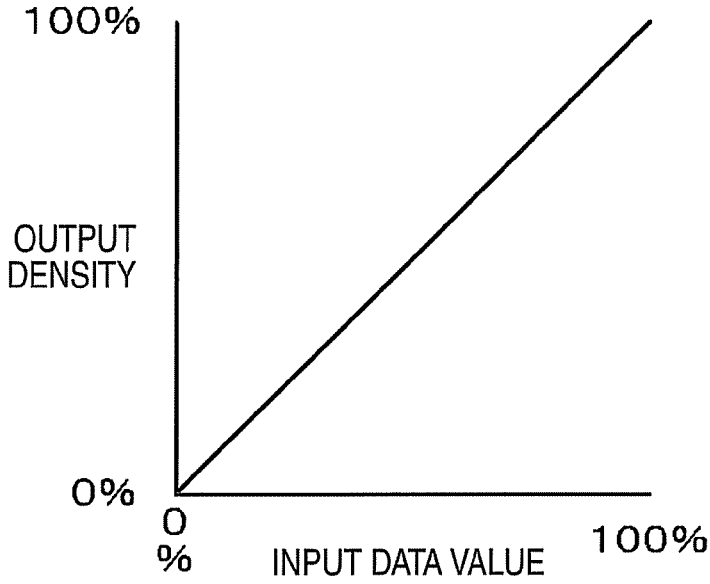
FIGS. 5A and 5B are views showing various characteristics for explaining a method of generating gradation correction parameters.
Figure 5B:
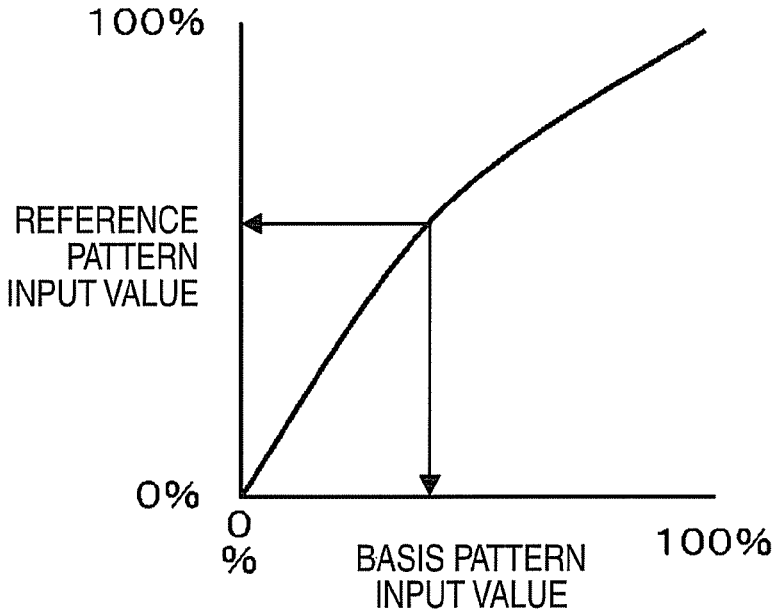

A method of generating the gradation correction parameter will be described with reference to characteristic views of FIGS. 5A and 5B. FIG. 5A is a view showing a characteristic of an output density value for an input data value, and FIG. 5B is a view showing a curve characteristic of the gradation correction parameter.

A horizontal axis in FIG. 5A represents a normalized input data value ranging from 0 to 100%, in which an 8 bit input corresponds to an input of 0 to 255. A vertical axis in FIG. 5A represents a normalized color density with the maximum of 100%.

In a normal state, output densities (percentage) become equal to an input value (percentage).

In the normal state, a low line number basis density pattern and a high line number reference density pattern have the same density for the same input.

It is here assumed that a state of an image forming apparatus (printer 20) is varied and a gradation characteristic of a high line number output is varied.

In this case, since the gradation characteristic of the low line number basis density pattern is difficult to vary as compared to that of the high line number reference density pattern, it has a gradation characteristic close to a normal density characteristic.

In this state, a user selects a reference density pattern which appears to have the same density as the basis density pattern, and inputs a gradation correction value corresponding to the selected reference density pattern.

The gradation correction parameter generating unit 219 obtains an input value to output the selected reference density pattern from the gradation correction value selected by the user.

The gradation correcting unit 214 determines a correction point with a horizontal axis value as an input value (percentage) of the basis density pattern and a vertical axis value as an input value of the reference density pattern selected by the user on the characteristic view (graph) of FIG. 5B.

A curve (correction lookup table (LUT)) joining three points, that is, the correction point, an origin (0, 0) and a maximum output point (100, 100) on the graph is generated and output as a gradation correction parameter [see FIG. 5B].

FIG. 5B shows an example of a case selected by the user, in which a gradation of the printer 20 is thinly varied and a reference pattern is thickly printed in a normal state.

The gradation correcting unit 214 performs a correction through an input data correction LUT.

In addition, the user selects a reference density pattern closest to the basis density pattern on the printed gradation correction chart 50 and inputs a gradation correction value corresponding to the selected reference density pattern to the printer 20. A processing operation by the printer 20 to perform a gradation correction of a corresponding pattern based on the input gradation correction value is equally performed using respective gradation correction charts 60Ya, 60Yb, 60Yc and 80Y in printers 20B, 20C, 20D and 20E according to exemplary embodiments to be described below (but, in the charts 60Ya, 60Yb, 60Yc and 80Y, the number of correction point in FIG. 5B is 3 since the user needs to select three points of high density, middle density and low density).

When the user determines a gradation correction value to be input to the printer 20 for the above-described gradation correction process, since the circumference of the yellow gradation correction pattern is covered by the dark blue color having the saturation contrast effect on the yellow color in the gradation correction chart 50 of the first exemplary embodiment, a precise shading determination between the yellow basis density pattern and the reference density pattern by visual observation using the saturation contrast effect can be achieved.

Second Exemplary Embodiment

Figure 6:
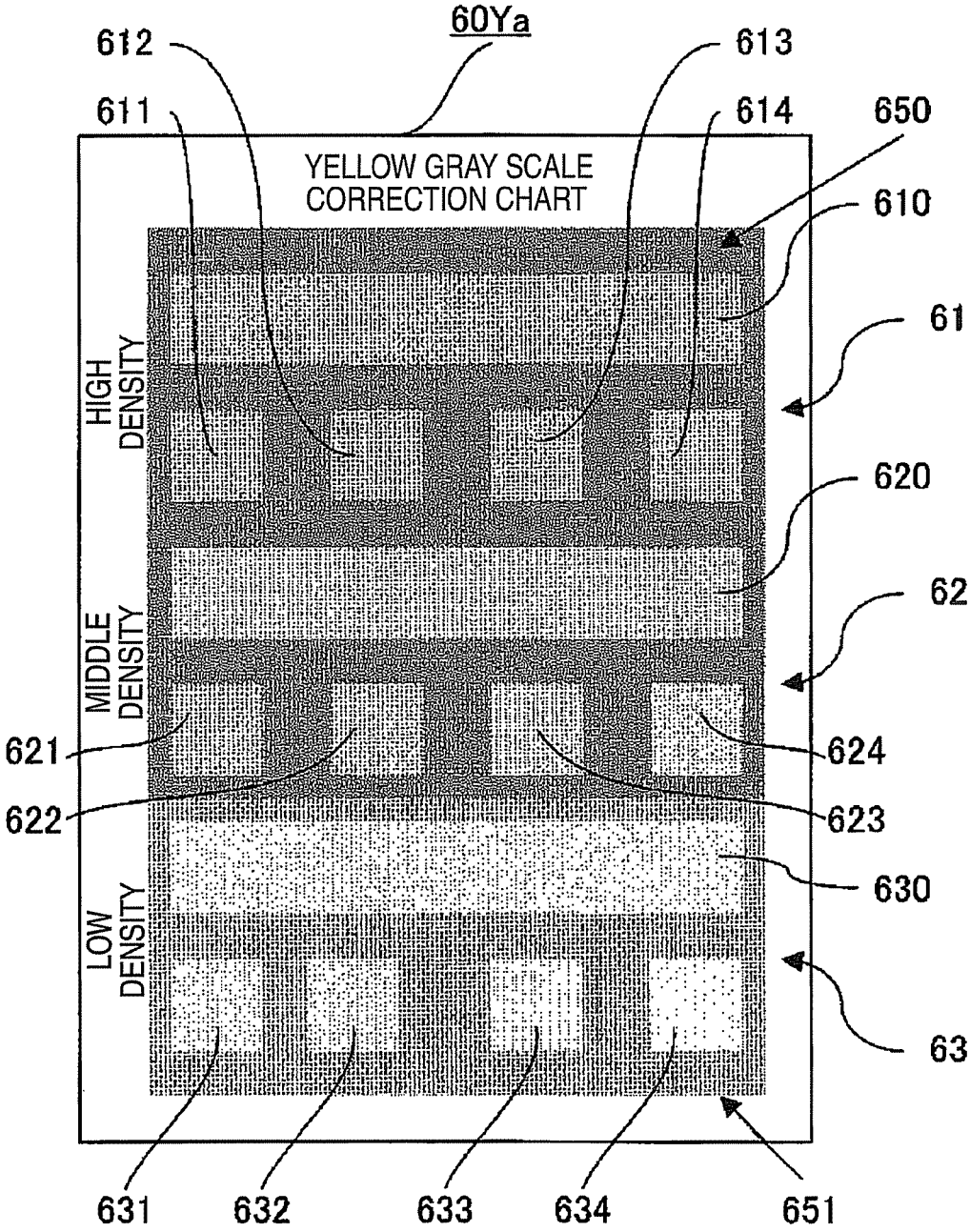
FIG. 6 is a view showing a result of printing of a gradation correction chart according to a second exemplary embodiment.

FIG. 6 is a view showing a print result of the gradation correction chart 60Ya in a printer 20B according to a second exemplary embodiment.

As shown in FIG. 6, the gradation correction chart 60Ya is a gradation correction chart for a yellow color and is composed of a Y color high density gradation correction pattern 61 printed on the upper side, a Y color middle density gradation correction pattern 62 printed on the middle side, and a Y color low density gradation correction pattern 63 printed on the lower side.

The Y color high density gradation correction pattern 61 has a structure in which a basis density pattern 610 having a basis high density of Y color and extending in the form of a band in a horizontal direction and reference density patterns lying below the basis density pattern 610 and having gradually varying densities (high densities) to be compared with the basis high density of Y color, that is, a reference density pattern 611 having a predetermined density, a reference density pattern 612 having a density lower than that of the reference density pattern 611, a reference density pattern 613 having a density lower than that of the reference density pattern 612, and a reference density pattern 614 having a density lower than that of the reference density pattern 613, are arranged and juxtaposed in a horizontal direction (band shape).

The Y color middle density gradation correction pattern 62 has a structure in which a basis density pattern 620 having a basis middle density of Y color and extending in the form of a band in a horizontal direction and reference density patterns lying below the basis density pattern 620 and having gradually varying densities (middle densities) to be compared with the basis middle density of Y color, that is, a reference density pattern 621 having a predetermined density, a reference density pattern 622 having a density lower than that of the reference density pattern 621, a reference density pattern 623 having a density lower than that of the reference density pattern 622, and a reference density pattern 624 having a density lower than that of the reference density pattern 623, are arranged and juxtaposed in a horizontal direction (band shape).

The Y color low density gradation correction pattern 63 has a structure in which a basis density pattern 630 having a basis low density of Y color and extending in the form of a band in a horizontal direction and reference density patterns lying below the basis density pattern 630 and having gradually varying densities (low densities) to be compared with the basis low density of Y color, that is, a reference density pattern 631 having a predetermined density, a reference density pattern 632 having a density lower than that of the reference density pattern 631, a reference density pattern 633 having a density lower than that of the reference density pattern 632, and a reference density pattern 634 having a density lower than that of the reference density pattern 633, are arranged and juxtaposed in a horizontal direction (band shape).

In addition, in the gradation correction chart 60Ya, a contrast effect pattern 650 of a dark blue color having a saturation contrast effect on the yellow color is arranged around the basis density pattern 610 and the reference density patterns 611, 612, 613 and 614 constituting the Y color high density gradation correction pattern 61 and the basis density pattern 620 and the reference density patterns 621, 622, 623 and 624 constituting the Y color middle density gradation correction pattern 62, and a contrast effect pattern 651 of a black color having a brightness contrast effect on the low density yellow color is arranged around the basis density pattern 630 and the reference density patterns 631, 632, 633 and 634 constituting the Y color low density gradation correction pattern 63.

When the printer 20B of the second exemplary embodiment prints such a gradation correction chart 60Ya, based on a print instruction of the yellow color gradation correction test chart from the client terminal 10, the gradation correction chart generating unit 215 of the functional configuration shown in FIG. 1 generates yellow color gradation correction test chart print data including bitmap data for juxtaposing and drawing the basis density pattern having the basis density for each density region (high, middle and low density) of the Y color and the plurality of reference density patterns having respective densities to be compared with the basis density and bitmap data for drawing a first contrast effect pattern of the dark blue color having the saturation contrast effect on the yellow color around the basis density pattern of a density range exceeding a predetermined density (in this example, high density and middle density) and the reference density patterns and drawing a second contrast effect pattern of the black color having the brightness contrast effect on the yellow color around the basis density pattern of a density range less than a predetermined density (in this example, low density) and the reference density patterns.

The screen processing unit 217 uses the low line number line screen to screen-process the basis density pattern data of the high density, the middle density and the low density of the Y color, the contrast effect pattern 650 around the gradation correction pattern data of the high density and the middle density of the Y color, and the contrast effect pattern 651 around the gradation correction pattern data of the low density of the Y color of the above-described yellow color gradation correction test chart print data, and uses the high line number line screen corresponding to the yellow color to screen-process the reference density pattern data of each density.

Based on the gradation correction test chart print data screen-processed by the screen processing unit 217, as shown in FIG. 6, the printing unit 22 prints the yellow color gradation correction test chart 60Ya in which the basis density pattern having the basis density of each density region (high, middle and low density) of the Y color and the plurality of reference density patterns having the respective densities to be compared with the basis density are juxtaposed and printed (as the gradation correction patterns 61, 62 and 63), the first contrast effect pattern 650 of the dark blue color having the saturation contrast effect on the yellow color around the basis density pattern having the density region (high density and middle density) exceeding a predetermined density and the reference density patterns is printed, and the second contrast effect pattern of the black color having the brightness contrast effect on the yellow color around the basis density pattern having the density region (low density) less than the predetermined density and the reference density patterns is printed.

In addition, based on a print instruction of a gradation correction chart to designate M color or C color from the client terminal 10, the printer 20B of the second exemplary embodiment may print M or C color gradation correction test chart 60Ma and 60Ca (not shown) in which a gradation correction pattern including a basis density pattern having a basis density for each density (high, middle and low density) of each of the M color and C color and a plurality of reference density patterns having gradually varying densities to be compared with the basis density is printed.

Third Exemplary Embodiment

Figure 7:
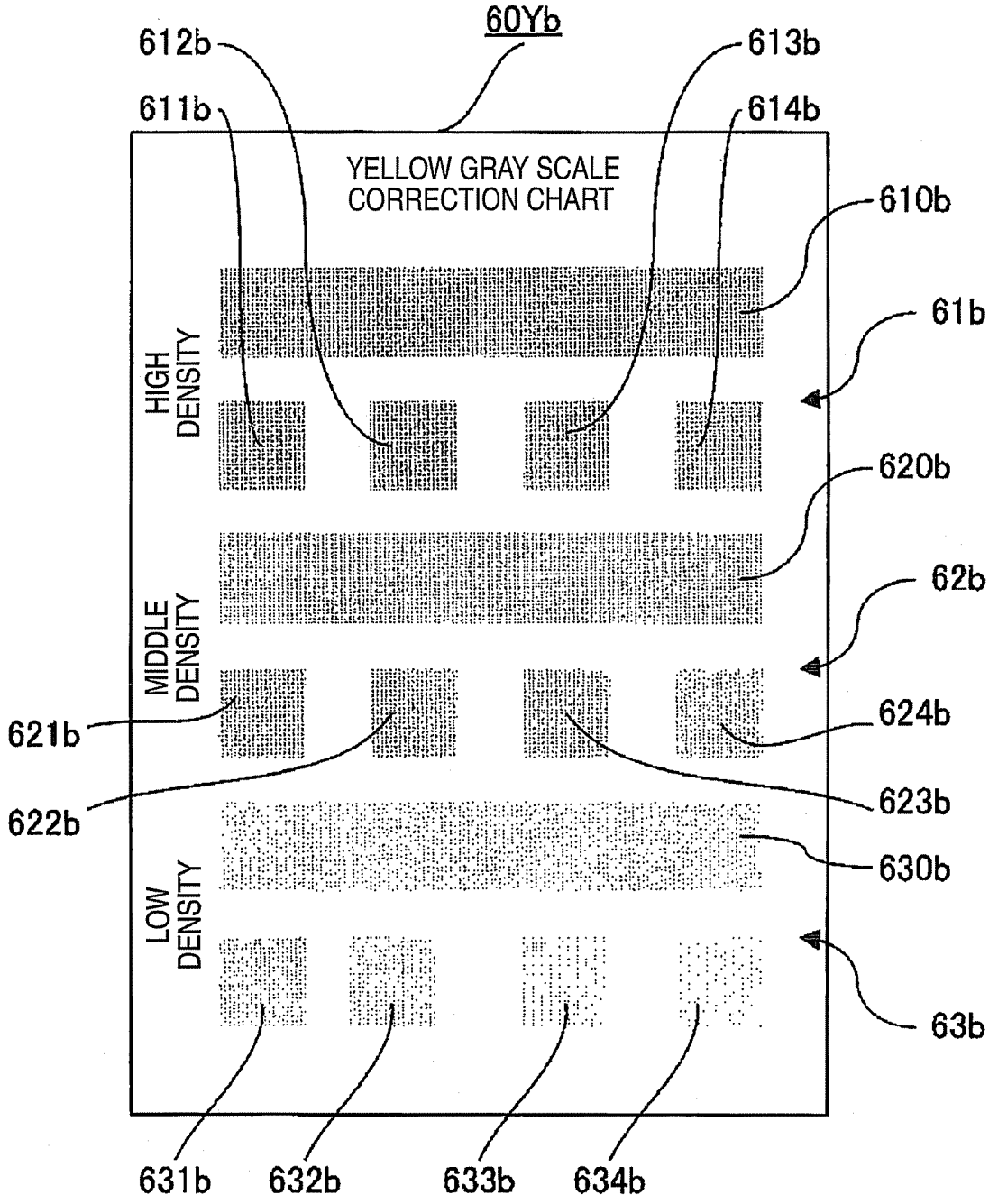
FIG. 7 is a view showing a result of printing of a gradation correction chart according to a third exemplary embodiment.

FIG. 7 is a view showing a print result of the gradation correction chart 60Yb in a printer 20C according to a third exemplary embodiment of the present invention.

As shown in FIG. 7, the gradation correction chart 60Yb is a gradation correction chart for a yellow color and is composed of a Y color high density gradation correction pattern 61*b* printed on the upper side, a Y color middle density gradation correction pattern 62*b* printed on the middle side, and a Y color low density gradation correction pattern 63*b* printed on the lower side.

In the Y color gradation correction chart 60Yb of the third exemplary embodiment, the arrangement, shape and density relationship between a basis density pattern 610*b* and reference density patterns 611*b*, 612*b*, 613*b* and 614*b*, a basis density pattern 620*b* and reference density patterns 621*b*, 622*b*, 623*b* and 624*b*, and a basis density pattern 630*b* and reference density patterns 631*b*, 632*b*, 633*b* and 634*b* in each of the high density gradation correction pattern 61*b*, the middle density gradation correction pattern 62*b* and the low density gradation correction pattern 63*b* is equal to the arrangement, shape and density relationship between the basis density pattern 610 and the reference density patterns 611, 612, 613 and 614, the basis density pattern 620 and the reference density patterns 621, 622, 623 and 624, and the basis density pattern 630 and the reference density patterns 631, 632, 633 and 634 in each of the high density gradation correction pattern 61, the middle density gradation correction pattern 62 and the low density gradation correction pattern 63 in the yellow color gradation correction chart 60Ya (see FIG. 6) according to the second exemplary embodiment.

However, according to the Y color gradation correction chart 60Yb of the third exemplary embodiment, a first embedded contrast effect pattern 652 (see FIGS. 8 to 11) according to a dark blue color line having a saturation contrast effect on the yellow color is embedded and printed for each of the basis density pattern 610*b* and the reference density patterns 611*b*, 612*b*, 613*b* and 614*b* within the high density gradation correction pattern 61*b* and the basis density pattern 620*b* and the reference density patterns 621*b*, 622*b*, 623*b* and 624*b* within the middle density gradation correction pattern 62*b*, and a second embedded contrast effect pattern 653 (see FIG. 12) according to a black line having a brightness contrast effect on the yellow color is embedded and printed for each of the basis density pattern 630*b* and the reference density patterns 631*b*, 632*b*, 633*b* and 634*b* within the low density gradation correction pattern 63*b*.

FIGS. 8 to 11 are conceptual views showing, by partial extraction and enlargement, a print result of the basis density pattern 610*b* and the reference density patterns 611*b*, 612*b* and 613*b* in the high density gradation correction pattern 61*b* of the Y color gradation correction chart 60Yb shown in FIG. 7.

Figure 8:
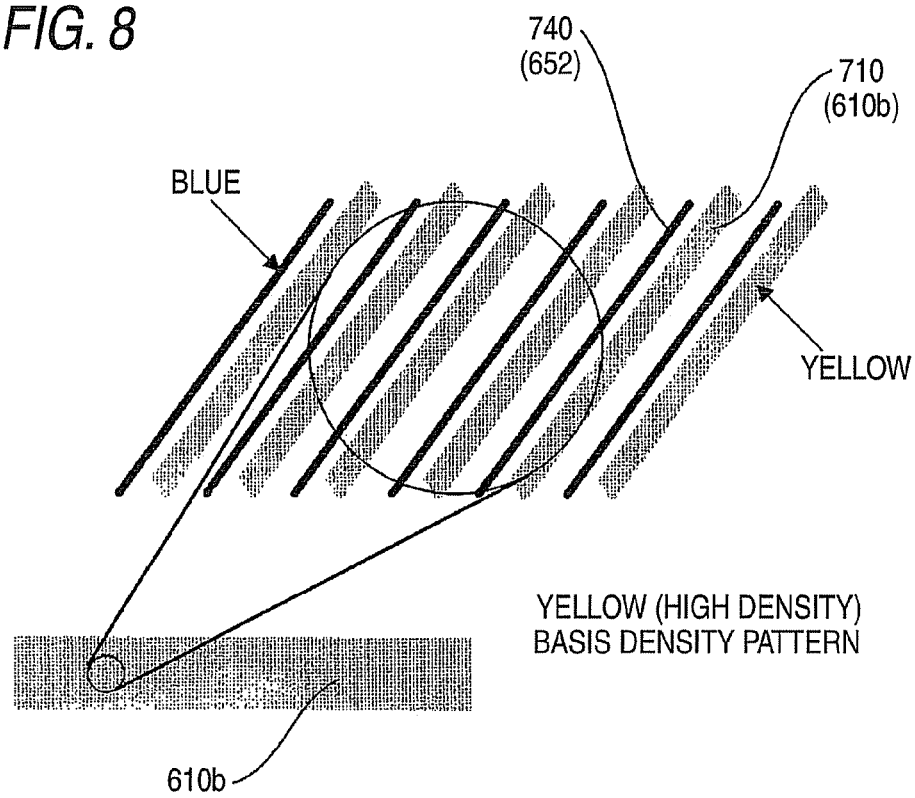
FIG. 8 is a partially-extracted and enlarged view of a basis density pattern 610*b* of a high density yellow color.

FIG. 8 is a partially-extracted and enlarged view of the basis density pattern 610*b* of the high density gradation correction pattern 61*b* of the Y color gradation correction chart 60Yb.

As shown in FIG. 8, the basis density pattern 610*b* is formed by consecutively arranging yellow color lines 710 which have a tilt angle equal to a screen angle of the low line number line screen used for the screen process of corresponding basis density pattern data and is composed of a number and thickness corresponding to an aspect ratio corresponding to the basis density, and the first embedded contrast effect pattern 652 corresponding to the basis density pattern 610*b* is formed by embedding dark blue color lines 740 having the same tilt angle at an appropriate pitch between the yellow color lines 710 constituting the basis density pattern 610*b*.

Figure 9:
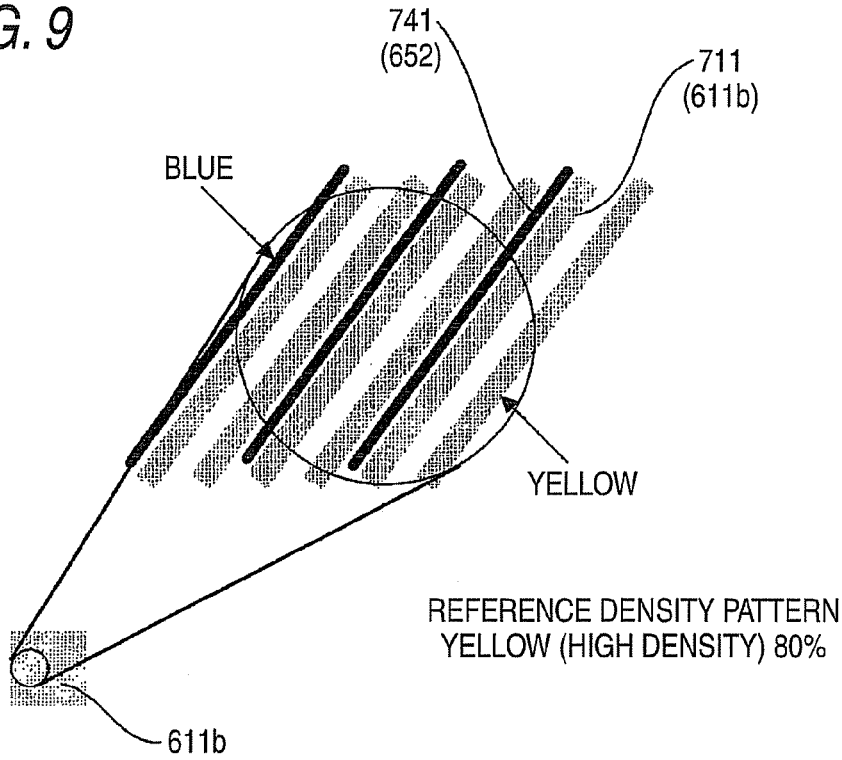
FIG. 9 is a partially-extracted and enlarged view of a reference density pattern 611*b* of a high density yellow color.

FIG. 9 is a partially-extracted and enlarged view of the reference density pattern 611*b* of the high density gradation correction pattern 61*b* of the Y color gradation correction chart 60Yb.

As shown in FIG. 9, the reference density pattern 611*b* is formed by consecutively arranging yellow color lines 711 which have a tilt angle equal to a screen angle of the yellow color high line number line screen used for the screen process of corresponding reference density pattern data and is composed of a number and thickness corresponding to an aspect ratio [for example, 80 percent (but, high density)] corresponding to the reference density, and the first embedded contrast effect pattern 652 corresponding to the reference density pattern 611*b* is formed by embedding dark blue color lines 741 having the same tilt angle at an appropriate pitch between the yellow color lines 711 constituting the reference density pattern 611*b*.

Figure 10:
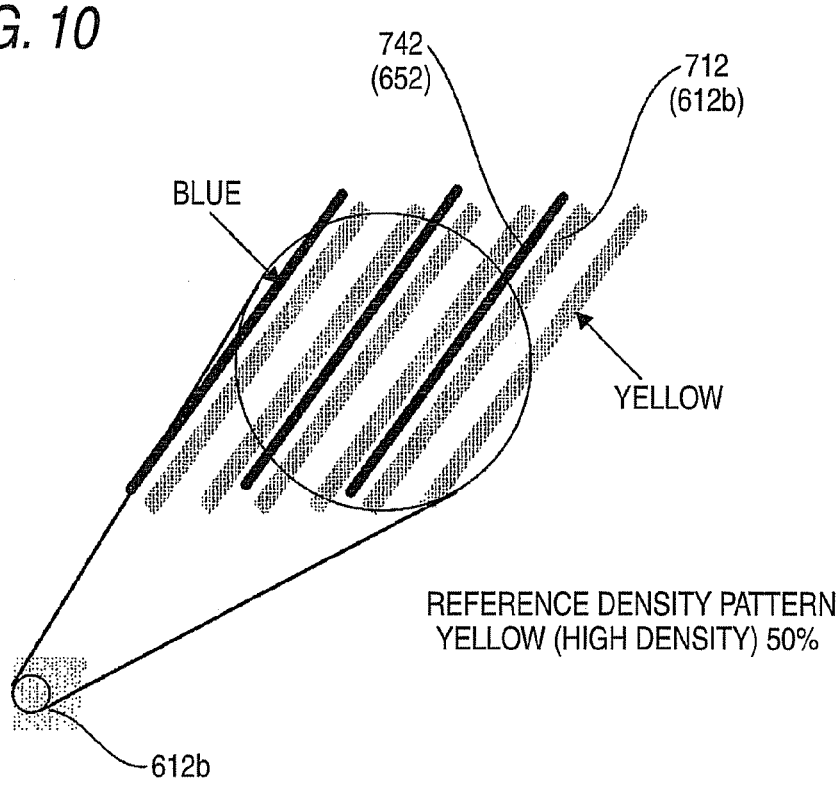
FIG. 10 is a partially-extracted and enlarged view of a reference density pattern 612*b* of a high density yellow color.

FIG. 10 is a partially-extracted and enlarged view of the reference density pattern 612*b* of the high density gradation correction pattern 61*b* of the Y color gradation correction chart 60Yb.

As shown in FIG. 10, the reference density pattern 612*b* is formed by consecutively arranging yellow color lines 712 which have a tilt angle equal to a screen angle of the yellow color high line number line screen used for the screen process of corresponding reference density pattern data and is composed of a number and thickness corresponding to an aspect ratio [for example, 50 percent (but, high density)] corresponding to the reference density, and the first embedded contrast effect pattern 652 corresponding to the reference density pattern 612*b* is formed by embedding dark blue color lines 742 having the same tilt angle at an appropriate pitch between the yellow color lines 712 constituting the reference density pattern 612*b*.

Figure 11:
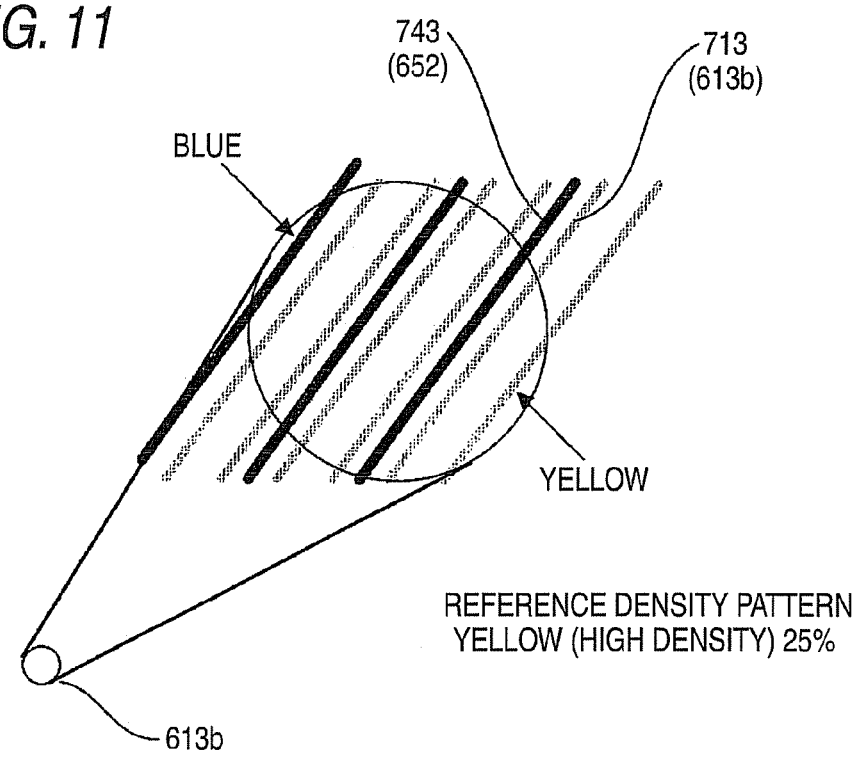
FIG. 11 is a partially-extracted and enlarged view of a reference density pattern 613*b* of a high density yellow color.

FIG. 11 is a partially-extracted and enlarged view of the reference density pattern 613*b* of the high density gradation correction pattern 61*b* of the Y color gradation correction chart 60Yb.

As shown in FIG. 11, the reference density pattern 613*b* is formed by consecutively arranging yellow color lines 713 which have a tilt angle equal to a screen angle of the yellow color high line number line screen used for the screen process of corresponding reference density pattern data and is composed of a number and thickness corresponding to an aspect ratio [for example, 25 percent (but, high density)] corresponding to the reference density, and the first embedded contrast effect pattern 652 corresponding to the reference density pattern 613*b* is formed by embedding dark blue color lines 743 having the same tilt angle at an appropriate pitch between the yellow color lines 713 constituting the reference density pattern 613*b*.

Similarly, for the Y color gradation correction chart 60Yb, the reference density pattern 614*b* of the high density gradation correction pattern 61*b* and the basis density pattern 620*b* and the reference density patterns 621*b*, 622*b*, 623*b* and 624*b* of the middle density gradation correction pattern 62*b* are formed by consecutively arranging yellow color lines which are composed of a number and thickness corresponding to an aspect ratio corresponding to the respective reference densities, and the first embedded contrast effect pattern 652 corresponding to the respective patterns is formed by embedding dark blue color lines having the same tilt angle at an appropriate pitch between the yellow color lines constituting the respective patterns.

Figure 12A:
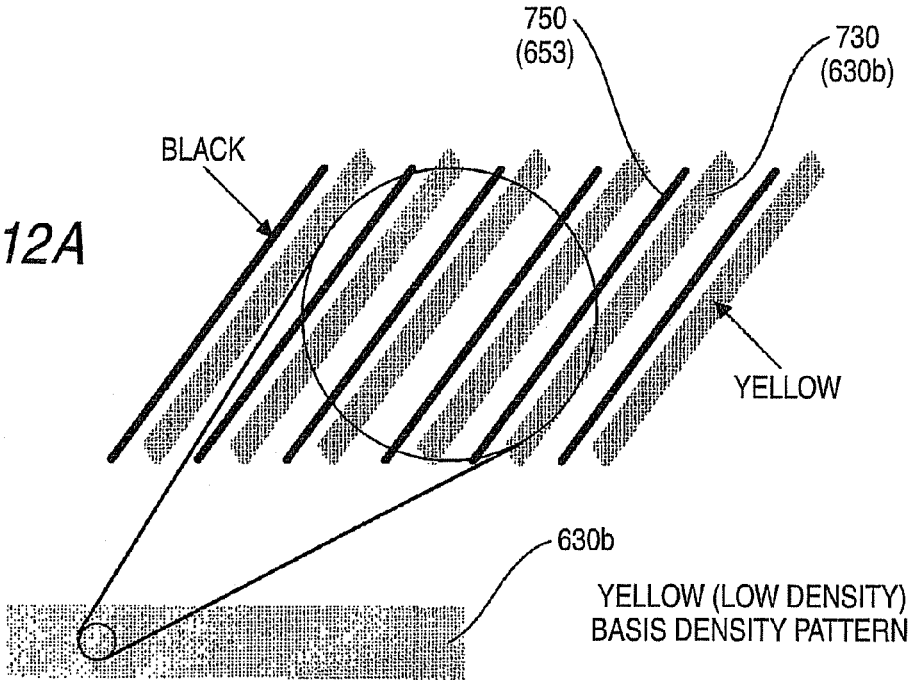
FIG. 12 is a partially-extracted and enlarged view of a basis density pattern 630*b* and a reference density pattern 631*b* of a low density yellow color.
Figure 12B:
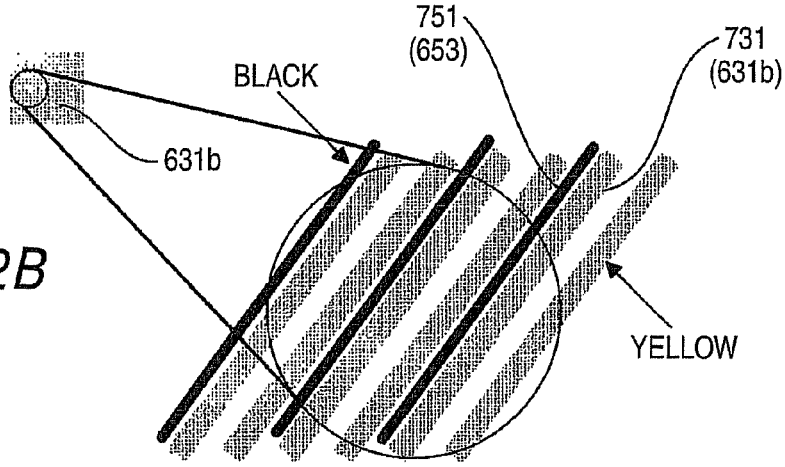

On the other hand, for the basis density pattern 630*b* and the reference density patterns 631*b*, 632*b*, 633*b* and 634*b* of the low density gradation correction pattern 63*b* on the Y color gradation correction chart 60Yb, the second embedded contrast effect pattern 653 of the type shown in FIGS. 12A and 12B is embedded and printed.

As one example, FIG. 12A is a partially-extracted and enlarged view of the basis density pattern 630*b* of the low density gradation correction pattern 63*b* of the Y color gradation correction chart 60Yb. FIG. 12B is a partially-extracted and enlarged view of the reference density pattern 631*b* of the low density gradation correction pattern 63*b* of the Y color gradation correction chart 60Yb.

As shown in FIG. 12A, the basis density pattern 630*b* is formed by consecutively arranging yellow color lines 730 which have a tilt angle equal to a screen angle of the low line number line screen used for the screen process of corresponding basis density pattern data and is composed of a number and thickness corresponding to an aspect ratio corresponding to the basis density, and the second embedded contrast effect pattern 653 corresponding to the basis density pattern 630*b* is formed by embedding black lines 750 having the same tilt angle at an appropriate pitch between the yellow color lines 730 constituting the basis density pattern 630*b*.

As shown in FIG. 12B, the reference density pattern 631*b* is formed by consecutively arranging yellow color lines 731 which have a tilt angle equal to a screen angle of the yellow color high line number line screen used for the screen process of corresponding basis density pattern data and is composed of a number and thickness corresponding to an aspect ratio (for example, 80 percent) corresponding to the reference density, and the second embedded contrast effect pattern 653 corresponding to the reference density pattern 631*b* is formed by embedding black lines 751 having the same tilt angle at an appropriate pitch between the yellow color lines 731 constituting the reference density pattern 631*b*.

Similarly, for the low density gradation correction pattern 63*b*, the reference density patterns 632*b*, 633*b* and 634*b* are also formed by arranging yellow color lines which are composed of a number and thickness corresponding to an aspect ratio (for example, 50 percent, 25 percent, 10 percent, etc.) corresponding to the respective reference densities, and the second embedded contrast effect pattern 653 is formed by embedding a predetermined number of black lines having the same tilt angle at an appropriate pitch between the yellow color lines.

According to the above-configured Y color gradation correction chart 60Yb of the third exemplary embodiment, for the high density and middle density gradation correction patterns 61*b* and 62*b* in which the dark blue color lines (embedded contrast effect pattern 652) are embedded and printed, it is possible to realize a precise shading determination of the basis density pattern and the reference density patterns of each density by the saturation contrast effect by the dark blue color on the yellow color in comparison of both patterns.

In addition, for the low density gradation correction pattern 63*b* in which the black lines (embedded contrast effect pattern 653) are embedded and printed, it is possible to realize a precise shading determination of the basis density pattern and the reference density patterns by the brightness contrast effect on the yellow color in comparison of both patterns.

When the printer 20C of the third exemplary embodiment prints this gradation correction chart 60Yb, based on a print instruction of the Y color gradation correction test chart from the client terminal 10, the gradation correction chart generating unit 215 of the functional configuration shown in FIG. 1 generates yellow color gradation correction test chart print data including bitmap data for juxtaposing and drawing the basis density pattern having the basis density for each density region (high, middle and low density) for the yellow color and the plurality of reference density patterns having respective densities to be compared with the basis density and bitmap data for embedding and drawing the first embedded contrast effect pattern 652 of the dark blue color having the saturation contrast effect on the yellow color for the basis density pattern and the reference density patterns of a density range exceeding a predetermined density (high density and middle density) and embedding and drawing the second embedded contrast effect pattern 653 of the black color having the brightness contrast effect on the yellow color for the basis density pattern and the reference density patterns of a density range less than a predetermined density (low density).

The yellow gradation correction pattern generated as above becomes equal to the data which have been already screen-processed. In order to avoid a double screen process, when the yellow color gradation correction test chart data are output, the screen process of the screen processing unit 217 is stopped and the input gradation correction test chart print data are output as they are.

Based on the gradation correction test chart print data, as shown in FIGS. 7 to 12, the printing unit 22 prints the yellow color gradation correction test chart 60Yb in which the basis density pattern having the basis density of each density region (high, middle and low density) of the Y color and the plurality of reference density patterns having the respective densities to be compared with the basis density are juxtaposed and printed, the first embedded contrast effect pattern 652 of the dark blue color for the basis density pattern and the reference density patterns having the density region (high density and middle density) exceeding a predetermined density is printed, and the second embedded contrast effect pattern 653 of the black color for the basis density pattern and the reference density patterns having the density region (low density) less than the predetermined density is printed.

Fourth Exemplary Embodiment

Figure 13:
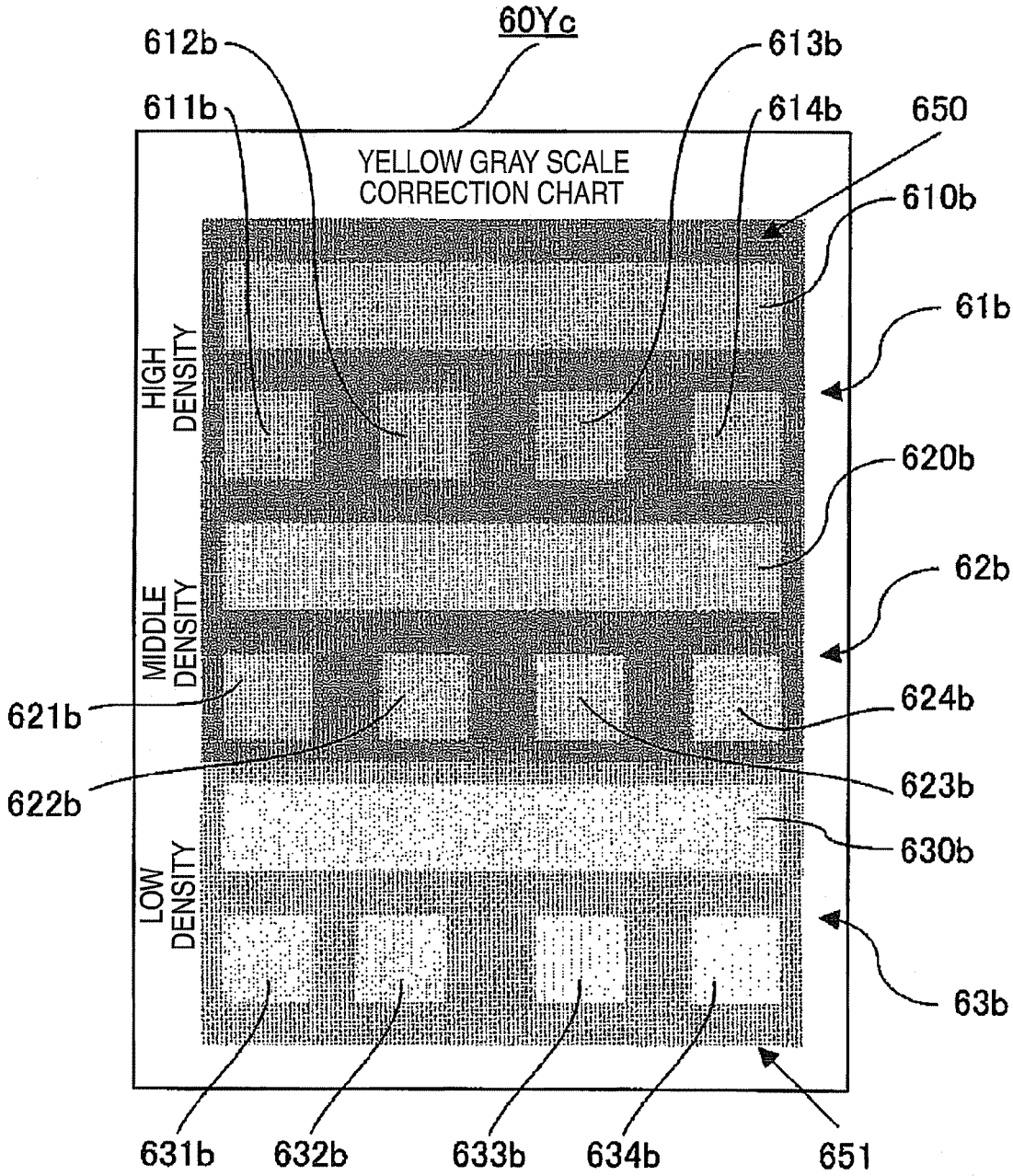
FIG. 13 is a view showing a result of printing a gradation correction chart according to a fourth exemplary embodiment.

FIG. 13 is a view showing a print result of the gradation correction chart 60Yc in a printer 20D according to a fourth exemplary embodiment of the present invention.

As shown in FIG. 13, the gradation correction chart 60Yc is a gradation correction chart for a yellow color and is composed of a Y color high density gradation correction pattern 61*b* printed on the upper side, a Y color middle density gradation correction pattern 62*b* printed on the middle side, and a Y color low density gradation correction pattern 63*b* printed on the lower side.

The Y color high density gradation correction pattern 61*b*, the Y color middle density gradation correction pattern 62*b* and the Y color low density gradation correction pattern 63*b* are equal to those denoted by the same reference numerals in the gradation correction chart 60Yb according to the third exemplary embodiment.

That is, the embedded contrast effect pattern 652 according to a dark blue color line is embedded and printed for each of the basis density pattern 610*b* and the reference density patterns 611*b*, 612*b*, 613*b* and 614*b* within the Y color high density gradation correction pattern 61*b* and the basis density pattern 620*b* and the reference density patterns 621*b*, 622*b*, 623*b* and 624*b* within the Y color middle density gradation correction pattern 62*b*, and the embedded contrast effect pattern 653 according to a black line is embedded and printed for each of the basis density pattern 630*b* and the reference density patterns 631*b*, 632*b*, 633*b* and 634*b* within the low density gradation correction pattern 63*b*.

In addition, in the gradation correction chart 60Yc, a contrast effect pattern 650 [equal to that of the second exemplary embodiment, (see FIG. 6)] of a dark blue color is arranged around the basis density pattern 610*b* and the reference density patterns 611*b*, 612*b*, 613*b* and 614*b* constituting the Y color high density gradation correction pattern 61*b* and the basis density pattern 620*b* and the reference density patterns 621*b*, 622*b*, 623*b* and 624*b* constituting the Y color middle density gradation correction pattern 62*b*, and a contrast effect pattern 651 [equal to that of the second exemplary embodiment, (see FIG. 6)] of a black color is arranged around the basis density pattern 630*b* and the reference density patterns 631*b*, 632*b*, 633*b* and 634*b* constituting the Y color low density gradation correction pattern 63*b*.

When the printer 20D of the fourth exemplary embodiment prints this gradation correction chart 60Yc, based on a print instruction of the yellow color gradation correction test chart from the client terminal 10, the gradation correction chart generating unit 215 of the functional configuration shown in FIG. 1 generates yellow color gradation correction test chart print data including bitmap data for juxtaposing and drawing the basis density pattern having the basis density for each density region (high, middle and low density) for the Y color and the plurality of reference density patterns having respective densities to be compared with the basis density, bitmap data for drawing the first contrast effect pattern 650 of the dark blue color having the saturation contrast effect on the yellow color around the basis density pattern and the reference density patterns of a density range exceeding a predetermined density (high density and middle density) and drawing the second contrast effect pattern 651 of the black color having the brightness contrast effect on the yellow color around the basis density pattern and the reference density patterns of a density range less than a predetermined density (low density), and bitmap data for embedding and drawing the first embedded contrast effect pattern 652 of the dark blue color having the saturation contrast effect on the yellow color for the basis density pattern and the reference density patterns of a density range exceeding a predetermined density (high density and middle density) and embedding and drawing the second embedded contrast effect pattern 653 of the black color having the brightness contrast effect on the yellow color for the basis density pattern and the reference density patterns of a density range less than a predetermined density (low density).

The yellow gradation correction pattern generated as above becomes equal to the data which have been already screen-processed. In order to avoid a double screen process, when the yellow color gradation correction test chart data are output, the screen process of the screen processing unit 217 is stopped and the input gradation correction test chart print data are output as they are.

Based on the gradation correction test chart print data, as shown in FIG. 13, the printing unit 22 prints the yellow color gradation correction test chart 60Yc in which the basis density pattern having the basis density for each density region (high, middle and low density) for the Y color and the plurality of reference density patterns having respective densities to be compared with the basis density are juxtaposed and printed, the first contrast effect pattern 650 of the dark blue color having the saturation contrast effect on the yellow color around the basis density pattern and the reference density patterns of a density range exceeding a predetermined density (high density and middle density) is printed, the second contrast effect pattern 651 of the black color having the brightness contrast effect on the yellow color around the basis density pattern and the reference density patterns of a density range less than a predetermined density (low density) is printed, the first embedded contrast effect pattern 652 of the dark blue color having the saturation contrast effect on the yellow color for the basis density pattern and the reference density patterns of a density range exceeding a predetermined density (high density and middle density) is embedded and printed, and the second embedded contrast effect pattern 653 of the black color having the brightness contrast effect on the yellow color for the basis density pattern and the reference density patterns of a density range less than a predetermined density (low density) is embedded and printed.

Fifth Exemplary Embodiment

Figure 14:
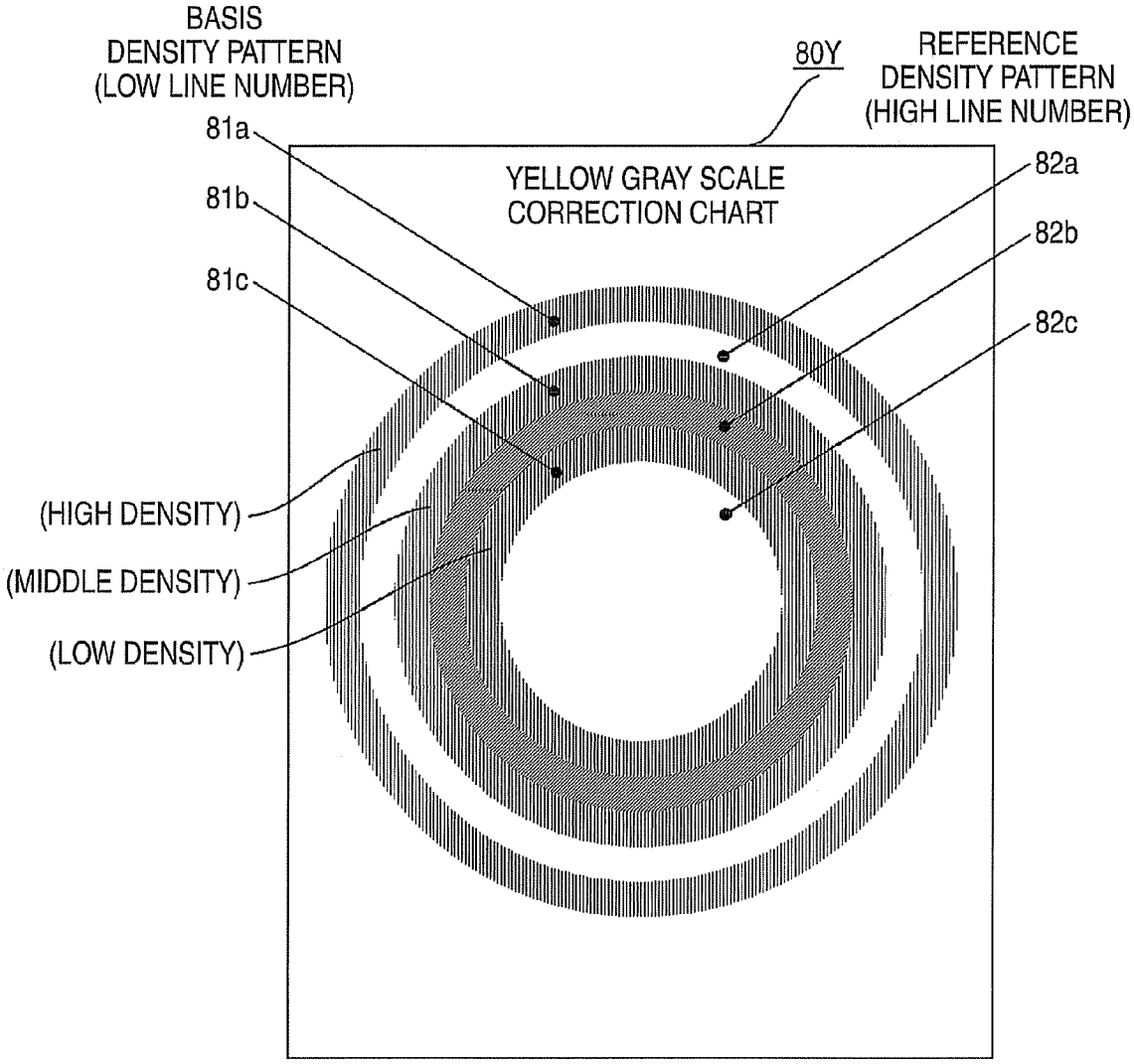
FIG. 14 is a view showing a result of printing a gradation correction chart according to a fifth exemplary embodiment.

FIG. 14 is a view showing a print result of the gradation correction chart 80Y in a printer 20E according to a fifth exemplary embodiment of the present invention.

As shown in FIG. 14, the gradation correction chart 80Y is a gradation correction chart for a yellow color and is composed of a Y color high density basis density pattern 81*a*, a Y color high density reference density pattern 82*a*, a Y color middle density basis density pattern 81*b*, a Y color middle density reference density pattern 82*b*, a Y color low density basis density pattern 81*c*, and a Y color low density reference density pattern 82*c*, all of which have a ring shape and contact each other in the form of concentric circles.

The basis density pattern 81*a* has a density as a basis of yellow high density, and the reference density pattern 81*b* contacting the inner side of the basis density pattern 81*a* has a density of a high density range continuously varying in, for example, a right-handed rotation of a circle (clockwise) [or left-handed rotation (counterclockwise)] for comparison with the basis density of the yellow color high density.

The basis density pattern 82*a* contacting the inner side of the reference density pattern 81*b* has a density as a basis of yellow middle density, and the reference density pattern 82*b* contacting the inner side of the basis density pattern 82*a* has a density of a middle density range continuously varying in, for example, a right-handed rotation of a circle (clockwise) [or left-handed rotation (counterclockwise)] for comparison with the basis density of the yellow color middle density.

The basis density pattern 83*a* contacting the inner side of the reference density pattern 82*b* has a density as a basis of yellow low density, and the reference density pattern 83*b* contacting the inner side of the basis density pattern 83*a* has a density of a low density range continuously varying in, for example, a right-handed rotation of a circle (clockwise) [or left-handed rotation (counterclockwise)] for comparison with the basis density of the yellow color low density.

In the yellow gradation correction chart 80Y, an embedded contrast effect pattern 850 according to a dark blue color line is embedded and printed in the yellow color high density gradation correction pattern (the basis density pattern 81*a* and the reference density pattern 81*b*) and the yellow color middle density gradation correction pattern (the basis density pattern 82*a* and the reference density pattern 82*b*), and an embedded contrast effect pattern 851 according to a black line is embedded and printed for the low density gradation correction pattern (the basis density pattern 83*a* and the reference density pattern 83*b*).

The embedded contrast effect patterns 850 and 851 can be embedded using the same method for the first embedded contrast effect pattern 652 and the second embedded contrast effect pattern 653 shown in the third and fourth exemplary embodiments, respectively.

When the printer 20E of the fifth exemplary embodiment prints this gradation correction chart 80Y, based on a print instruction of the yellow color gradation correction test chart from the client terminal 10, the gradation correction chart generating unit 215 of the functional configuration shown in FIG. 1 generates yellow color gradation correction test chart print data including bitmap data for alternately and concentrically arranging and drawing the basis density patterns having the basis density for each density region (high, middle and low density) for the Y color and the reference density patterns having respective continuously varying densities to be compared with the basis density, and bitmap data for embedding and drawing the first embedded contrast effect pattern 850 of the dark blue color for the basis density patterns and the reference density patterns of a density range exceeding a predetermined density (high density and middle density) and embedding and drawing the second embedded contrast effect pattern 851 of the black color for the basis density patterns of a density range less than a predetermined density (low density) and the reference density patterns.

The yellow gradation correction pattern generated as above becomes equal to the data which have already been screen-processed. In order to avoid a double screen process, when the yellow color gradation correction test chart data are output, the screen process of the screen processing unit 217 is stopped and the input gradation correction test chart print data are output as they are.

Based on the yellow color gradation correction test chart print data, as shown in FIG. 14, the printing unit 22 prints the yellow color gradation correction test chart 80Y in which the basis density patterns 81*a*, 82*a* and 83*a* having the basis density for each density region (high, middle and low density) for the Y color and the reference density patterns 81*b*, 82*b* and 83*b* having respective continuously varying densities to be compared with the basis density are alternately and concentrically arranged and printed, the first embedded contrast effect pattern 850 of the dark blue color having the saturation contrast effect on the yellow color for the basis density patterns 81*a* and 82*a* and the reference density patterns 81*b* and 82*b* of a density range exceeding a predetermined density (high density and middle density) is embedded and printed, and the second embedded contrast effect pattern 851 of the black color having the brightness contrast effect on the yellow color for the basis density pattern 83*a* and the reference density pattern 83*b* of a density range less than a predetermined density (low density) is embedded and printed.

In addition, the present invention is not limited to the above exemplary embodiments shown in the drawings but may be modified in a proper way without departing from the spirit and scope of the invention.

For example, although it has been illustrated in the above exemplary embodiments that the dark blue color furthest from the yellow color on the color space is used as a contrast effect pattern around or within the yellow color gradation correction pattern, the present invention is not limited thereto but may apply a blue color close to the dark blue color within a valid range of the saturation contrast effect on the yellow color.

In addition, although it has been illustrated in the above exemplary embodiments that a shape of the basis density pattern is rectangular and a shape of the reference density pattern is square, or a shape of both of the basis density pattern and the reference density pattern is annular, the shape and arrangement of the basis density pattern and the reference density pattern are not limited thereto but may be implemented in various forms.

In addition, although it has been illustrated in the above exemplary embodiments that the gradation correction chart generating unit 215 generates the gradation correction test chart print data composed of bitmap data, the gradation correction chart generating unit 215 may generate the gradation correction test chart print data composed of PDL drawing instructions or the like.

INDUSTRIAL APPLICABILITY

The present invention can be applied to image forming apparatuses such as color laser printers and the like having a calibration or gradation correction function to correct a gradation characteristic which is varied due to factors such as temporal variation, environmental variation or the like, and gradation correction test charts used for the calibration of the image forming apparatuses. The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An image forming apparatus comprising:

print data generating unit for generating gradation correction test chart print data to juxtapose and draw a basis density pattern having a basis density of a yellow color of various colors including the yellow color used for multicolor printing and a plurality of reference density patterns having respective densities of the yellow color to be compared with the basis density and additionally draw a contrast effect pattern composed of colors having a contrast effect on the yellow color for the basis density pattern and the reference density patterns of the yellow color;

printing unit for printing a gradation correction test chart including a yellow color gradation correction pattern in which the basis density pattern and the plurality of reference density patterns are juxtaposed and printed and the contrast effect pattern is additionally printed, based on the gradation correction test chart print data generated by the print data generating unit;

receiving unit for receiving an input of a density adjustment value of any pattern based on a shading comparison of the basis density pattern and the reference density patterns by a user's visual observation of the density correction test chart printed by the printing unit; and gradation correcting unit for performing a gradation correction of any pattern based on the density adjustment value of any pattern received by the receiving unit, wherein the print data generating unit generates yellow color gradation correction test chart print data to juxtapose and draw a basis density pattern having a basis density for each density and a plurality of reference density patterns having respective densities to be compared with the basis density, embed and draw a first embedded contrast effect pattern composed of a blue color for the basis density pattern and the reference density patterns of a density range exceeding a predetermined density, and embed and draw a second embedded contrast effect pattern composed of a black color for the basis density pattern and the reference density patterns of a density range less than the predetermined density, based on a print instruction of the yellow color gradation correction test chart, and wherein the printing unit prints a yellow color gradation correction test chart in which the basis density pattern and the plurality of reference density patterns are juxtaposed and printed, the first embedded contrast effect pattern composed of the blue color for the basis density pattern and the reference density patterns of a density range exceeding a predetermined density is embedded and printed, and the second embedded contrast effect pattern composed of the black color for the basis density pattern and the reference density patterns of a density range less than the predetermined density is embedded and printed, based on the yellow color gradation correction test chart print data.

2. The image forming apparatus according to claim 1, wherein the print data generating unit generates the gradation correction test chart print data to juxtapose and draw a basis density pattern having a basis density of a corresponding color of the various colors and a plurality of reference density patterns having respective densities of the corresponding color to be compared with the basis density and draw a contrast effect pattern composed of a blue color around the basis density pattern and the reference density patterns of the yellow color, based on a print instruction of the gradation correction test chart, and wherein the printing unit prints the gradation correction test chart in which the basis density pattern and the plurality of reference density patterns are juxtaposed and printed and the contrast effect pattern composed of the blue color around the basis density pattern and the reference density patterns of the yellow color is printed, based on the gradation correction test chart print data.

3. The image forming apparatus according to claim 1, wherein the print data generating unit generates yellow color gradation correction test chart print data to juxtapose and draw a basis density pattern having a basis density for each density range of a yellow color and a plurality of reference density patterns having respective densities to be compared with the basis density, draw a first contrast effect pattern composed of a blue color around the basis density pattern and the reference density patterns of a density range exceeding a predetermined density, and draw a second contrast effect pattern composed of a black color around the basis density pattern and the reference density patterns of a density range less than the predetermined density, based on a print instruction of the yellow color gradation correction test chart, and wherein the printing unit prints a yellow color gradation correction test chart in which the basis density pattern and the plurality of reference density patterns are juxtaposed and printed, the first contrast effect pattern composed of the blue color with around the basis density pattern and the reference density patterns of a density range exceeding a predetermined density is printed, and the second contrast effect pattern composed of the black color with around the basis density pattern and the reference density patterns of a density range less than the predetermined density is printed, based on the yellow color gradation correction test chart print data.

4. The image forming apparatus according to claim 3, wherein the print data generating unit generates yellow color gradation correction test chart print data to juxtapose and draw a basis density pattern having a basis density for each density range of a yellow color and a plurality of reference density patterns having respective densities to be compared with the basis density, embed and draw a first embedded contrast effect pattern composed of a blue color for the basis density pattern and the reference density patterns of a density range exceeding a predetermined density, and embed and draw a second embedded contrast effect pattern composed of a black color for the basis density pattern and the reference density patterns of a density range less than the predetermined density, based on a print instruction of the yellow color gradation correction test chart, and wherein the printing unit prints a yellow color gradation correction test chart in which the basis density pattern and the plurality of reference density patterns are juxtaposed and printed, the first embedded contrast effect pattern composed of the blue color for the basis density pattern and the reference density patterns of a density range exceeding a predetermined density is embedded and printed, and the second embedded contrast effect pattern composed of the black color for the basis density pattern and the reference density patterns of a density range less than the predetermined density is embedded and printed, based on the yellow color gradation correction test chart print data.

5. The image forming apparatus according to claim 1, wherein the print data generating unit generates yellow color gradation correction test chart print data to concentrically and alternately arrange and draw a basis density pattern having a basis density for each density range of a yellow color and reference density patterns having respective continuously varying densities to be compared with the basis density, embed and draw a first embedded contrast effect pattern composed of a blue color for the basis density pattern and the reference density patterns of a density range exceeding a predetermined density, and embed and draw a second embedded contrast effect pattern composed of a black color for the basis density pattern and the reference density patterns of a density range less than the predetermined density, based on a print instruction of the yellow color gradation correction test chart, and wherein the printing unit prints a yellow color gradation correction test chart in which the basis density pattern and the reference density patterns are concentrically and alternately arranged and printed, the first embedded contrast effect pattern composed of a blue color for the basis density pattern and the reference density patterns of a density range exceeding a predetermined density is embedded and printed, and the second embedded contrast effect pattern composed of a black color for the basis density pattern and the reference density patterns of a density range less than the predetermined density is embedded and printed, based on the yellow color gradation correction test chart print data.

6. A gradation correction test chart printed by an image forming apparatus including receiving unit for receiving an input of a density adjustment value of any pattern based on a shading comparison of a basis density pattern and reference density patterns by a user's visual observation of the gradation correction test chart, and gradation correcting unit for performing a gradation correction of any pattern based on the density adjustment value of any pattern received by the receiving unit, wherein the image forming apparatus juxtaposes and prints a basis density pattern having a basis density of a yellow color of various colors including the yellow color used for multicolor printing and a plurality of reference density patterns having respective densities of the yellow color to be compared with the basis density and additionally prints a contrast effect pattern composed of colors to increase a contrast effect on the yellow color for the basis density pattern and the reference density patterns of the yellow color, wherein the print data generating unit generates yellow color gradation correction test chart print data to juxtapose and draw a basis density pattern having a basis density for each density range of a yellow color and a plurality of reference density patterns having respective densities to be compared with the basis density, embed and draw a first embedded contrast effect pattern composed of a blue color for the basis density pattern and the reference density patterns of a density range exceeding a predetermined density, and embed and draw a second embedded contrast effect pattern composed of a black color for the basis density pattern and the reference density patterns of a density range less than the predetermined density, based on a print instruction of the yellow color gradation correction test chart, and wherein the printing unit prints a yellow color gradation correction test chart in which the basis density pattern and the plurality of reference density patterns are juxtaposed and printed, the first embedded contrast effect pattern composed of the blue color for the basis density pattern and the reference density patterns of a density range exceeding a predetermined density is embedded and printed, and the second embedded contrast effect pattern composed of the black color for the basis density pattern and the reference density patterns of a density range less than the predetermined density is embedded and printed, based on the yellow color gradation correction test chart print data.

* * * * *